US005134806A

United States Patent [19]

Burkart, Jr.

[11] Patent Number: 5,134,806

[45] Date of Patent: Aug. 4, 1992

[54] SECURITY GATE SAFETY DEVICES

[76] Inventor: James A. Burkart, Jr., 2054 Chadds Ford Dr., Reston, Va. 22091

[21] Appl. No.: 747,405

[22] Filed: Aug. 19, 1991

Related U.S. Application Data

[63] Continuation of Ser. No. 568,785, Aug. 17, 1990, abandoned.

[51] Int. Cl.[5] ..... E06B 3/32

[52] U.S. Cl. ..... 49/463; 49/55

[58] Field of Search ..... 292/300, 259 R; 49/463, 49/55, 57; 160/215; D25/50; 248/251

[56] References Cited

U.S. PATENT DOCUMENTS

| | | | |
|---|---|---|---|
| 572,778 | 12/1896 | Stevenson | 248/251 |
| 1,055,127 | 5/1913 | Boger . | |
| 1,332,924 | 3/1920 | Sikorovsky . | |
| 1,752,683 | 4/1930 | Meagher | 248/251 |
| 1,961,781 | 6/1934 | Reagle | 248/251 |
| 2,574,807 | 11/1951 | Woodruff | 20/71 |
| 2,577,034 | 12/1951 | Quinlan | 160/217 |
| 2,982,353 | 5/1961 | Luser | 160/183 |
| 3,163,205 | 12/1964 | Gottlieb | 160/216 |
| 4,492,263 | 1/1985 | Gebhard | 160/228 |
| 4,607,455 | 8/1986 | Bluem et al. | 49/55 |
| 4,611,431 | 9/1986 | Lauro | 49/55 |
| 4,643,318 | 2/1987 | Kopp | 248/251 |
| 4,677,791 | 7/1987 | Larson | 49/463 |
| 4,831,777 | 5/1989 | Johnson | 49/55 |
| 4,874,278 | 10/1989 | Kawashita | 411/386 |
| 4,884,614 | 12/1989 | Spurling | 160/225 |
| 4,944,117 | 7/1990 | Gebhard et al. | 49/55 |

FOREIGN PATENT DOCUMENTS

| | | | |
|---|---|---|---|
| 2357660 | 11/1973 | Fed. Rep. of Germany | 14/463 |
| 2013163 | 8/1978 | Fed. Rep. of Germany | 248/251 |
| 2058186 | 4/1981 | United Kingdom . | |
| 2198172 | 6/1988 | United Kingdom | 49/55 |
| 2214551 | 6/1989 | United Kingdom . | |

*Primary Examiner*—Renee S. Luebke
*Assistant Examiner*—Darnell Boucher

[57] ABSTRACT

Disclosed are a bumper retaining device (20) and a latch holding device (40) which facilitate the safe use of pressure mounted security gates (10) commonly used for children or pets. The bumper retaining device (20) consists of a plate (22) with a hollow (24) on the upper side, configured to receive and retain frictional bumpers (14) of the security gate (10). Two bumper retaining devices (20), one on each side of a passageway, are to be positioned to receive two upper bumpers (14). The bumper retaining device (20) keeps the security gate (10) from being dislodged. A latch holding device (40) keeps the latch (30), which controls width and pressure of the security gate (10), from falling out of adjustment. A kit is assembled of the inventive devices for easy installation by a home owner.

6 Claims, 4 Drawing Sheets

SECURITY GATE SAFETY DEVICES

This is a division of Ser. No. 568,785, filed Aug. 17, 1990, now abandoned.

BACKGROUND

Field of Invention

This invention relates to child and pet security gates, specifically to devices that enhance the safety and ease of use of security gates.

INTRODUCTION

The invention is directed mainly toward those types of security gates that are held in place by "frictional bumpers" on opposite sides of a passageway. Such a passageway typically would be a doorjamb, hallway or window jam. The security gate in question contains moveable parts which when properly adjusted create compressive forces which frictionally engages bumpers to opposite sides of an opening, holding the gate in place. This type of security gate therefore can be termed herein, as a "frictionally-held" security gate or a "pressure mounted" security gate.

One compression inducing mechanism, which is common in the current market place, involves two levers, one of which has a ring attached at the free end, the other lever of which has a uniform row of notches along its length. Rings have been made of solid pieces of bent metal or a composition of plates and rivets. The levers can be adjusted relative to each other by setting the ring into one of the notches and clamping the two levers together. This mechanism allows adjustment of the gate width with simultaneous adjustment of the compressive force which hold the gate in place. This type of mechanism can be termed herein, as a "lever-latch".

One condition observed with the use of frictionally-held security gates is the vulnerability of the frictional bumper contacts to lateral displacement, or slippage, due to typical activities of children. Lateral displacement can occur under normal conditions to the point of sudden and violent failure of the system. This is an obvious safety hazard.

Another condition is the tendency to adjust the gate to a state of over-compression to compensate for this vulnerability to lateral displacement. This can cause damage to walls in contact with the frictional bumpers as well as to the security gate itself. But the security gate is observed to be vulnerable to lateral displacement and failure, even in this state of over-compression.

The endeavor of this invention is not only to provide components that technically work, but ones that are easy to use, cost effective, versatile and esthetically pleasing. Consequentially, the invention will likely have considerable positive impact on the safe and proper use security gates.

The following includes descriptions of some of the currently marketed security gates to which this invention can apply:

1) Nu-Line Industries of Suring, Wis., produce Models #202 and #162. These and similar models by Nu-Line utilize wooden lever-latches and circular frictional bumpers of approximately 2.5 cm diameter.

2) Worldsbest Industries of Cudahy, Wis., produces model #275, which utilizes a wooden lever-latch and circular frictional bumpers of approximately 2.5 cm diameter.

3) Seymour Juvenile of Seymour, Ind., produces model #276, which utilizes a wooden lever-latch and circular frictional bumpers of approximately 2.5 cm diameter.

4) North State Industries of Minn., produce Super Gate (Trademark) model #1612, which has circular frictional bumpers of approximately 2.5 cm diameter and a plastic pressure inducing mechanism.

5) Fisher Price of East Aurora, N.Y., produces a Sure-Grip Gate (Trademark), which has frictional bumpers and an apparently sophisticated pressure inducing mechanism. Patent is pending for this product. The frictional bumpers are rectangular with rounded corners, 2.4 cm in width and 3.5 cm in height.

6) Century Product Co. of Macedonia, Ohio, produces a child security gate model #14-502, which has a swinging gate using elastic frictional bumpers at the ends of threaded rods to frictionally hold the gate frame in place. On one side, the frictional bumpers are generally rectangularly shaped with circular end on the tops and bottoms. These circular ends have an approximate 2.9 cm diameter. The bumpers on the other side consists of disks with diameter of approximately 3.8 cm.

7) Gerry Baby Products of Gerico, Colo. produces 4-Sure (Trademark) which utilizes a spring loaded pressure mechanism and frictional bumpers to hold the gate in place. The frictional bumpers are approximately 3.2 to 3.5 cm in diameter.

The inventive bumper retaining device applies to all of the above mentioned products, with the possible exception of 4-Sure, produced by Gerry Baby Products, which may be excluded because the manufacturer's installation instructions conflict with the practical use of the inventive bumper retaining device.

PRIOR ART

U.S. Pat. No. 4,677,791 provides for a mounting system consisting of a socket for each of four frictional bumpers; each socket is secured to the door jamb and is configured to receive and retain a frictional bumper. Two types of mounting members are presented, one for flat surfaces, such as door jambs and walls, the other for wrought iron railings.

Each socket consists of a rectangular base with a front and back face. The front-face is defined by a U-shaped rib projecting outwardly from the base. The back-face has a recessed rectangular area containing a double-faced adhesive. A hole is provided in the base !or a screw mounting. The U-shaped rib on the front-face is to be configured to accept and hold the frictional bumper of a security gate.

The adhesive on the back-face is described as the primary means of mounting the device. The adhesive is described as entirely adequate for the vast majority of situations, the screw mounting was provided for additional strength.

One problem with the adhesive backing is that it apparently relies on the surface strength of the material to which it is attached, including paint, or paper in the case of drywall or wall paper. Another problem with a strong adhesive is that its removal will probably cause damage to, or removal of, surface material, whether it be wood, paint, drywall or wall paper.

Another apparent problem with the invention of U.S. Pat. No. 4,677,791 is its difficulty of use. Four sockets, two on each wall, are required. One difficulty is the necessity of synchronizing the positioning of the four sockets during installation. Then to operate the design of U.S. Pat. No. 4,677,791 seems to require simultaneous tedious adjustment of the width/compression mechanism and alignment of gate so that the four bumpers insert into the four sockets. Also, the bumpers would probably tend to catch on the top of the rectangular base while being inserted into the sockets. In addition, if screws were installed in the rectangular bases, the bumpers would tend to catch on the screw heads.

It is stated in U.S. Pat. No. 4,677,791 that it is that the major member of the socket preferably be molded from plastic. Because of its complicated design, and considerations of cost and esthetics, plastic is probably the only feasible material from which the major member could be made. This limits manufactures to those who can mold plastic.

The sole use of plastic as a main member has an esthetic disadvantage. Plastic is difficult to paint or stain to match the woodwork or walls to which it is attached.

The U-shaped projection on the face of invention of U.S. Pat. No. 4,677,791 would likely be a safety problem. At child height in a trafficked passageway, the projections would be a probable source of cuts, other injuries and damages.

Another invention, G.B. Pat. No. 2198172A, uses a rubber bumper and rubber socket combination to hold a security gate in place. Compression, as shown in the patent drawings, is induced by the adjustment of threaded rods attached to the rubber bumpers. The socket and the bumper presented are of logical but unusual configuration. The socket evidently is restricted to receive only the bumper of the specific configuration illustrated.

Four sockets would probably be required for the majority of frictionally-held security gates utilizing lever-latches or similar compression inducing mechanisms. Removing and resetting the gate into four sockets would tend to be tedious. The aesthetic disadvantages of having rubber sockets installed on a wall are obvious.

Other patents, such as U.S. Pat. No. 4,884,614, depict devices which hold security gates in place, but the type of security gates in question are not frictionally-held. Therefore, these patents are hardly relevant to this the current invention.

The inventive bumper retaining device differs in form, use and operation from even the most-similar patented devices. Physically, the inventive bumper retaining device does not necessarily have a component that separates the frictional bumper from the wall surface as previously patented devices do. The inventive bumper retaining device simply compliments and facilitates the normal use and operation of security gates; but, the most-similar patented devices require alteration to the adjustment of the security gate itself. The inventive bumper retaining device is not a structurally fundamental appendage to the system as are the most-similar patented devices. In other words, if the inventive bumpers retainers are removed, the security gate can remain installed as it was so designed; if the previously patented devices are removed, the security gate is also necessarily removed.

OBJECTS AND ADVANTAGES

The most-similar patented devices are set apart from the inventive devices herein, by physical, functional and operational differences. However, objects and advantages of the inventive bumper retaining device and of the latch holding device, can be demonstrated by comparison with the shortcoming of the most-similar patented devices. Also, objects and advantages of this invention relate directly to basic social values of safety and utility. Several objects and advantages of the present invention are:

(a) to provide a bumper retaining device whose attachment to the wall surface relies on penetration into structurally sound matter (as opposed to surface adhesion);

(b) to provide a device whereby removal and resetting of the security gate can be accomplished with ease;

(c) in reference to (b), to provide a bumper retaining system which requires only two retainers (instead of four sockets);

(d) in reference to (b), to provide a bumper retaining device which allows the bumpers to slip into place without interference from components of the bumper retaining device itself;

to provide bumper retaining device attachment mechanism such that installation and removal the bumper retaining device is less likely, than the previously presented adhesive attachment mechanism, to cause very noticeable damage to the surface to which it is attached;

(f) to provide a bumper retaining device that can be esthetically congruent with the surface to which it is attached;

(g) to provide a bumper retaining device that is easy to install;

(h) to provide a bumper retaining device that is simple in configuration and therefore efficient to manufacture;

(i) to provide a bumper retaining device design that feasibly can be manufactured from more than one source material, which broadens the range of possible manufacturers and can be adaptable to various demands of consumers;

(j) to provide a bumper retaining device that is flat in contour so to not be a likely source of cuts and other injuries;

Further objects and advantages are to provide through the combination of components of the invention, a system which precludes dangerous lateral movement in the bumper wall contact, a system which enhances the ease of use of child/pet security gates, a system which enhances the proper usage of child/pet security gates. Still further objects and advantages will become apparent from a consideration of the ensuing description and drawings.

DRAWING FIGURES

REFERENCE NUMERALS IN DRAWINGS

10—security gate
11—gate panel

12—gate panel
14—frictional bumper
16—passageway
16a—passageway wall
16b—passageway wall
18 —unsuitable bearing material (gypsum board)
19—suitable bearing material (wood)
20 —bumper retaining device
22—plate
24—hollow
24a—end of hollow
24b—end of hollow
26—face edges
27—fasteners
28—holes for fasteners
30—lever-latch

DESCRIPTION

Figure 1:
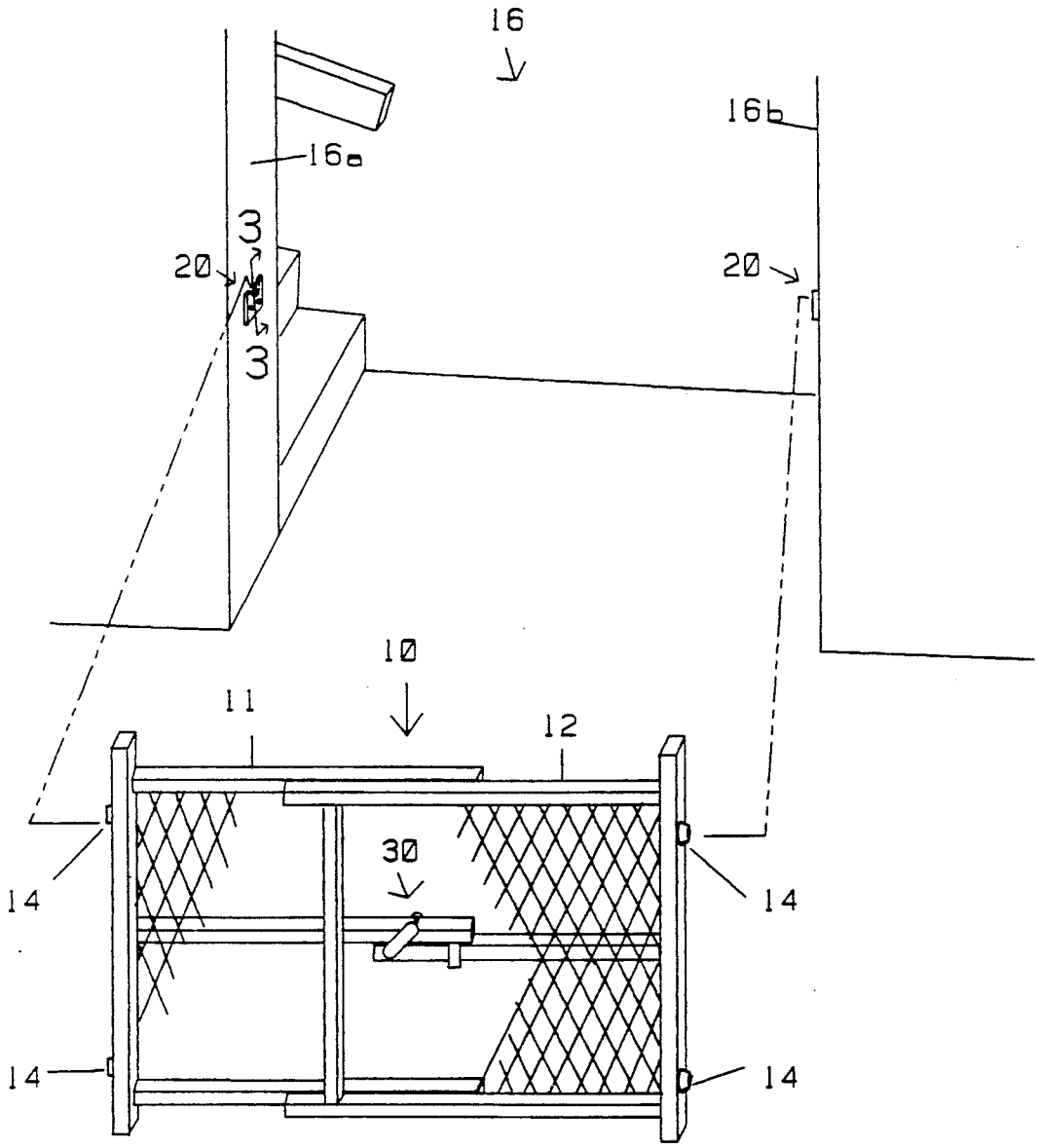
FIG. 1 is an exploded perspective view showing the security gate in conjunction with the inventive bumper retaining devices.

With reference to FIG. 1, a security gate represented generally by numeral 10 is mounted at a passageway, generally represented by numeral 16. From the perspective view of FIG. 1, the passageway is bordered by a wall on the left 16a and a wall on the right 16b. The inventive bumper retaining device 20, is positioned on wall 16a, and an identical bumper retaining device 20 is positioned on wall 16b.

The security gate 10 is modeled after the model #202 security gate produced by NU-LINE. The security gate has two sections 11,12 that slide past each other to approximate the width of the passageway 16. A lever-latch for controlling the width and compressive state of the security gate 10 within the passage way 16 is represented generally by numeral 30. In all, there are four frictional bumpers 14, two on each side of the security gate 10.

Figure 2:
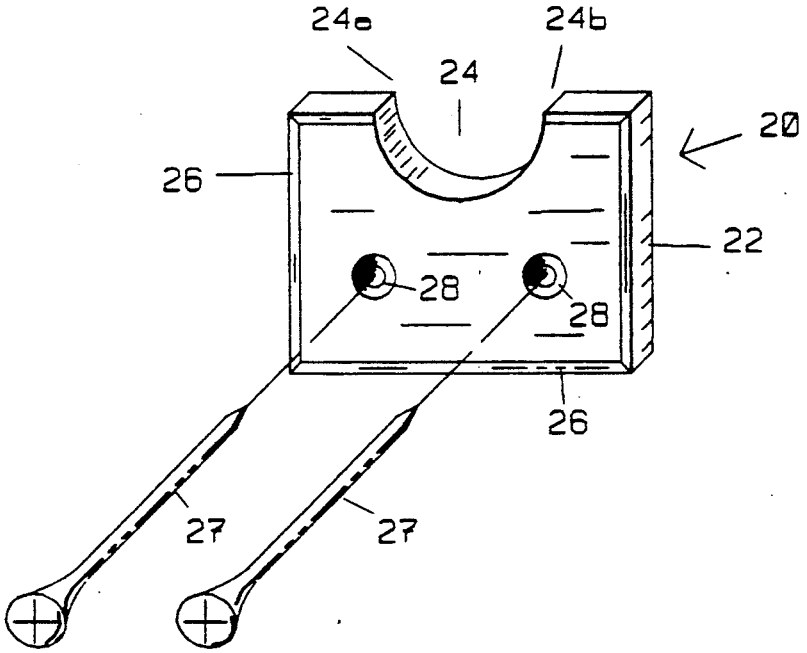
FIG. 2 is a perspective view showing the inventive bumper retaining device, from the front side.

FIG. 2 depicts a perspective view of the inventive bumper retainer 20. In this embodiment, the major member is basically a rectangular plate 22 with an approximate semi-circular hollow 24 on the upper side. However, the plate 22 and the hollow 24 can be of various shapes. The thickness of the plate 22 can typically range from approximately 0.6 cm to approximately 1 cm, or slightly less than the compressed state of the frictional bumper 14.

Two small holes 28 are provide for the penetration of two fasteners 27, such as nails or screws. The preferred embodiment would be the use of self-drilling screws. These would preclude the necessity of pre-drilling and can be installed by manual drivers, such as a hand operated screw driver, into drywall and into most types of wood. The particular screws illustrated in FIG. 2 are modeled after Bugle Head - Self Drilling Drywall Screws (Trademark), manufactured by VSI Fasteners, Inc. of Stanton, Calif. This particular screw receives the powerful grip of the common #2 Phillips screwdriver, which facilitates installation. The holes 28 are bevelled to receive these screws 27.

Face edges 26 in FIG. 2 are bevelled. These face edges can be sanded, cut or molded to be round or bevelled, depending on the material of the major member 20. The plate 20 can be of various materials, including plastic, wood or metal. Regarding wood, high quality plywood is preferred, because of its strength and resistance against splitting.

If the material of plate 22 is wood, the hollow 24 may be drilled with a wood bit. The radius of the hollow 24 should be large enough to receive the frictional bumper 14. For many of currently marketed products, this radius would be at least approximately 1.3 cm. The hollow 24 may be oversized in comparison with the frictional bumper. The ends of the semi-circular hollows 24a and 24b can be sanded, cut or molded to flange outwards to more readily accept the frictional bumper 14 (See FIG. 4). However, it is observed that frictional bumpers readily slip into the semi-circular hollow 24, without specially shaped flanges. It is also observed that a variety of shapes and sizes of frictional bumpers 14 can be retained using a semi-circular configuration of the hollow 24. Due to manufacturing efficiency and applicability, the preferred embodiment would be the approximate semi-circular hollow 24.

Figure 3:
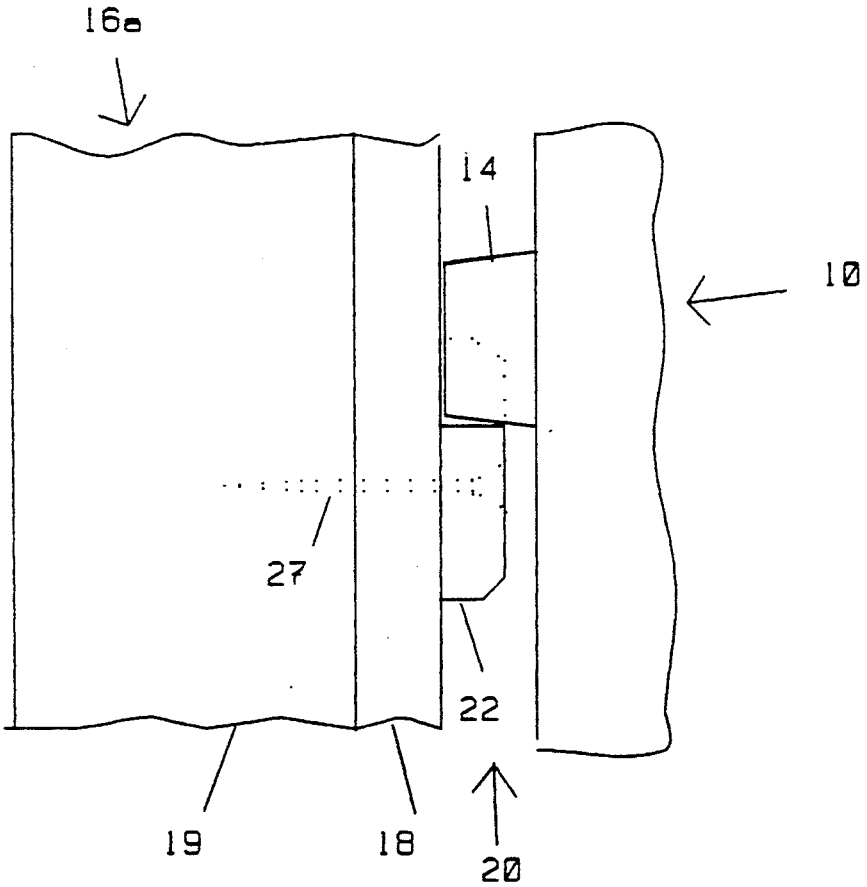
FIG. 3 is an engineering sectional view of the inventive bumper retaining device installed on a drywall surface.

FIG. 3 shows a cross-sectional view of the inventive bumper retainer 20 on the left wall 16a of FIG. 2. The frictional bumper 14 is positioned in the hollow 24 of the bumper retainer 20. A fastener 27 is indicated by broken lines.

As is depicted in FIG. 3 the fasteners 27 must be long enough to pass through unsuitable bearing material 18, such as gypsum board or plaster, to become adequately anchored in a suitable bearing material 19, such as wood or metal. Using self-drilling screws as fasteners 27, a screw length of approximately 3.3 cm appears to adequately penetrate sound bearing material 19, such as wood, after passing through approximately 1.3 cm of gypsum board and a 1.0 cm thickness of the bumper retainer 20. Therefore an adequate penetration into wood appears to be approximately 1.0 cm if using self-drilling screws as a fastener 27.

Figure 4:
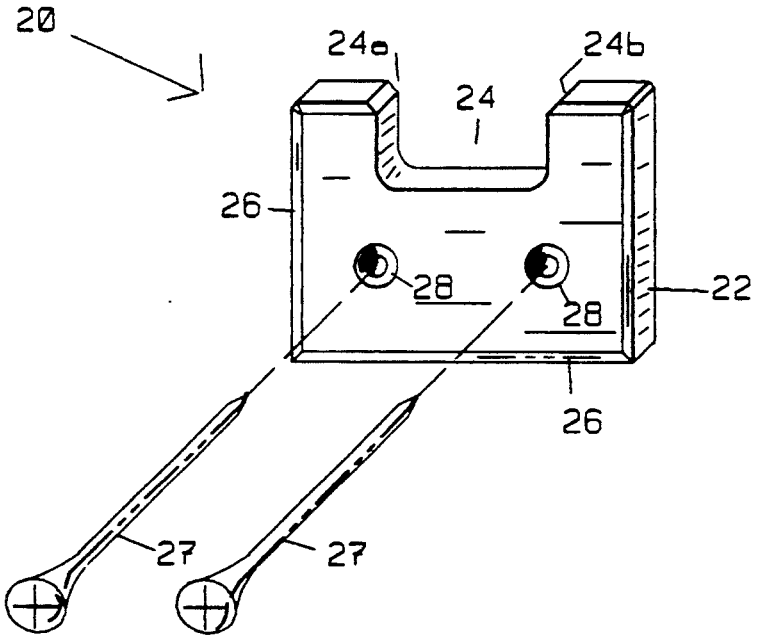
FIG. 4 is a perspective view of an alternate embodiment of the inventive bumper retaining device, from the front side.

Another embodiment of the inventive bumper retaining device 20 is shown in FIG. 4. This embodiment is similar to that of FIG. 2, but with a rectangularly configured hollow 24. The rectangularly configured hollow 24, is modeled to conform to frictional bumpers of the Fisher Price Sure-Grip.

In these specifications, dimensions and material sources given are for descriptive purposes. Pursuant patent claims are not to be bound by disclosure of this information.

This invention is to compliment the usual operation of security gates 10, not replace any function. For the preferred embodiment, being that of FIG. 2, before installation of this invention, a security gate is to be installed according to the manufacturer's instruction. Preferably, the security gate 20 would be positioned to clear any flooring of the passageway 16, at least by 1. cm. The location of the two upper frictional bumpers 14 are to be marked. Then the security gate 10 can be removed and the inventive bumper retaining devices 20 installed at the locations defined by the marks. The bumper retaining devices 20 can be fixed to a wall by driving fasteners 27 through the small holes 28 of the plates 22 into the wall. The preferred embodiment is the use of self-drilling screws to preclude the need for a drill. Installation of the embodiment of FIG. 4, would require more precise measurements of the location of bumper retaining devices 20, should four bumper retaining devices be required.

The security gate 10 should be operated according to manufacturer's instruction, however, this operation is made easier, and the use is made safer, by installations of this invention. With utilization of this invention, the security gate 10 can be taken down and reset while the width and compression stay securely in adjustment. For resetting, the correct locations for the top bumpers 14 are made definite by the positions of the bumper retaining devices 20. In this way the bumper retaining 20 device acts as a template which facilitates ease of use and keeps the security gate 10 in correct alignment with the walls 16*a*,16*b*. Typically, the security gate 10 conveniently can be reset first by placing an upper bumper 14 into a bumper retaining device 20, then while extending the security gate 10 and clasping the lever-latch 30, the other upper bumper 14 can be slipped into the other bumper retaining device 20, while the lower bumpers 14 are kept in adequate vertical alignment with the upper bumpers 14.

Summary, Ramifications, and Scope

The reader will see that this invention advances values regarding safety, ease of use, ease of installation, damage to the wall surface, damage to the security gate, applicability, aesthetics, cost of manufacturing and retail.

Safety is enhanced because:

(1) security gates are retained from lateral displacement and failure;

(2) bumper retainers are firmly anchored into the wall by deepsetting screws and nails rather than relying on surface adhesion;

(3) bumper retaining devices make it easier to use security gates properly therefore they are more likely to be used properly;

(4) flat plates are used for retaining the frictional bumpers, rather than projecting components which are more likely to cause cuts and other injuries to passersby.

Ease of use is enhanced because:

(1) the position of the two retainers provides a temp resetting the two upper frictional bumpers, then the bottom two frictional bumpers easily are aligned with the help of gravity;

(2) the security gate is required to be slipped into two bumper retainers rather than installed into four sockets;

Ease of installation is enhanced because:

(1) two bumper retainers are required to be installed rather than four sockets;

(2) the only tools required in the preferred embodiment are a screwdriver and a marking utensil, i.e., a pencil;

(3) measurements are not required, positioning of the retainers is determined by the positioning of the security gate according to the manufactures instructions.

Damage to the wall surface and security gate is prevented because:

(1) the preferred embodiment of using two screws leaves two small holes to be patched upon removal rather than an area stripped of surface material;

(2) with the use of the retainers the gate will be less likely to be over-compressed, which causes damage to the security gate itself as well as the walls.

Applicability will be enhanced because:

(1) the preferred embodiment of the retainer with an approximate semi-circle hollow, is able to be used with many of the currently marketed security gates with frictional bumpers.

Aesthetics are enhanced because:

(1) the bumper retainers can be made of wood or plastic to match the material of the security gate;

(2) the bumper retainers made of wood, can be stained, or painted, to match the wall or woodwork to which it is attached.

Cost of manufacturing and retail is likely to be low because:

(1) the design is very simple;

(2) the bumper retainer plates can be manufactured from a variety of materials, wood, plastic or metal;

(3) only two bumper retaining deices are required rather than four sockets.

While my above description contains many specificities, these should not be construed as limitations on the scope of the invention, but rather as an exemplification of an embodiment thereof. Many other variations are possible. For example: the outline of the retainer plate could be oval rather than rectangular in shape. Accordingly, the scope of the invention should be determined not by the embodiments illustrated, but by the appended claims and their legal equivalents.

I claim:

1. In combination:

a pressure mounting security gate, for use in a passageway, comprising relatively moveable components with at least two frictional bumpers, one upper frictional bumper and one lower frictional bumper, both bumpers located on a vertical member of the security gate, each frictional bumper of predetermined configuration, with a width, the security gate further comprising means for effecting movement between said components to vary the effective width of the gate and for pushing the moveable components apart causing the security gate to be in a compressed state so that the upper frictional bumper and the lower frictional bumper are compressed against a wall surface of the passageway, and a retaining device for use with the security gate, the retaining device comprising:

a plate with a thickness and with a hollow on an upper side;

the hollow configured to accept and retain a frictional bumper, the hollow extending the thickness of the plate, so that the frictional bumper of the mounted security gate is in direct contact with the wall surface of the passageway, whereby the frictional bumpers can be slipped along the wall surface into the hollow without interference from the plate, and the mounted security gate is not displaced from the wall surface by the plate;

the plate thickness less than or equal to the width of the compressed frictional bumper;

the plate thickness, retains the frictional bumper, such that there is no horizontal member projecting from the plate to retain the frictional bumper;

a fastening means for fixing the plate to a flat area of the wall surface such that the plate cannot be rotated or otherwise displaced, whereby the frictional bumpers of the mounted security gate are retained, wherein the fastening means penetrates the plate thickness.

2. The retaining device defined in claim 1, wherein two retaining devices, one at each end of the security gate, are positioned on wall surfaces of the passageway to retain two upper frictional bumpers of the mounted security gate.

3. The retaining device defined in claim 1, wherein the plate is fixed to the wall surface by two self-drilling screws through two holes in said plate, whereby a drill is not required.

4. The retaining device defined in claim 1, wherein the hollow is of approximately semi-circular configuration, whereby the hollow can be manufactured by drilling.

5. The retaining device defined in claim 1, wherein front edges of the plate are blunted by sanding, cutting or molding to a round or beveled configuration, whereby injury and damage to passerby is avoided.

6. The retaining device defined in claim 1, wherein the hollow is of approximate rectangular configuration.

* * * * *

UNITED STATES PATENT AND TRADEMARK OFFICE
CERTIFICATE OF CORRECTION

PATENT NO. : 5,134,806

DATED : Aug, 4, 1992

INVENTOR(S) : James A. Burkart, Jr.

It is certified that error appears in the above-identified patent and that said Letters Patent is hereby corrected as shown below:

Col 1,line54,add at beginning of paragraph --This invention has a device, hereinafter called a "bumper retaining device" or simply a "bumper retainer", into which frictional bumpers can be inserted and secured to effectively contain lateral displacement--

Col 3,line 2,change --Then to operate the design of-- to --Operation of--

Col 3,line 68,change --However, object-- to --Objects--

Col 4,line 21,change --to-- to --(e) to--

Col 6,line 24,change --approximately-- to --more than--

Col 6,line 29,change --approximately-- to --more than--

Col 6,line 56,delete --Installation of the embodiment of FIG. 4, would require more precise measurements of the location of bumper retaining devices 20, should four bumper retaining devices be required.--

Col 6,line 63,delete --With utilization of this invention, the security gate 10 can be taken down and reset while the width and compression stay securely in adjustment.--

Col 7,line 31,change --temp-- to --template for--

Col 7,line 37,change --;-- to --.--

UNITED STATES PATENT AND TRADEMARK OFFICE
CERTIFICATE OF CORRECTION

PATENT NO. : 5,134,806

DATED : Aug. 4, 1992

INVENTOR(S) : James A. Burkart, Jr.

It is certified that error appears in the above-identified patent and that said Letters Patent is hereby corrected as shown below:

ABSTRACT

Line 1 of the abstract, change --Disclosed are a bumper retaining device (20) and a latch holding device (40) which facilitate the safe-- to --Disclosed is a bumper retaining device (20) which facilitates safe--

Line 11 of the abstract, delete -- A latch holding device (40) keeps the latch (30), which controls width and pressure of the security gate (10), from falling out of adjustment.--

Signed and Sealed this

Twenty-eighth Day of September, 1993

Bruce Lehman

*Attest:*

BRUCE LEHMAN

*Attesting Officer*

*Commissioner of Patents and Trademarks*